US009386898B2

(12) United States Patent
Masquin

(10) Patent No.: US 9,386,898 B2
(45) Date of Patent: Jul. 12, 2016

(54) WASHING COMBINATION FOR THE CLEANING OF FLOORS OR OTHER PLANAR SURFACES

(71) Applicant: Julien Masquin, Courthezon (FR)

(72) Inventor: Julien Masquin, Courthezon (FR)

(73) Assignee: ETS PAUL MASQUIN (S.A.S.), Courthezon (FR)

( * ) Notice: Subject to any disclaimer, the term of this patent is extended or adjusted under 35 U.S.C. 154(b) by 541 days.

(21) Appl. No.: 13/866,482

(22) Filed: Apr. 19, 2013

(65) Prior Publication Data

US 2014/0310974 A1 Oct. 23, 2014

(51) Int. Cl.
*A47L 13/14* (2006.01)
*A47L 13/142* (2006.01)

(52) U.S. Cl.
CPC ..... *A47L 13/142* (2013.01); *A47L 13/14* (2013.01)

(58) Field of Classification Search
CPC ..... A47L 13/14; A47L 13/142
See application file for complete search history.

(56) References Cited

U.S. PATENT DOCUMENTS

| | | | | |
|---|---|---|---|---|
| 3,224,025 | A | 12/1965 | Altrock et al. | |
| 2002/0162573 | A1 | 11/2002 | Fernandez | |
| 2006/0026785 | A1* | 2/2006 | Sampaio | A47L 13/142 15/120.1 |
| 2009/0165232 | A1* | 7/2009 | Libman | A47L 13/255 15/120.2 |

FOREIGN PATENT DOCUMENTS

| | | | |
|---|---|---|---|
| DE | 10058690 | C1 | 11/2002 |
| EP | 1112713 | A1 | 7/2001 |
| EP | 1208788 | A1 | 5/2002 |
| WO | 02071908 | A2 | 9/2002 |

* cited by examiner

*Primary Examiner* — Randall Chin
(74) *Attorney, Agent, or Firm* — Egbert Law Offices, PLLC

(57) ABSTRACT

Method of wringing of the sponge mop pad provided on mops comprising a soleplate whereon is applied such a pad, and fixed to the distal end of a shaft, characterized in that the cleaning and the wringing of the mop pad are obtained simultaneously by placing the unit comprised of said soleplate and said mop pad in a position parallel to the axis of the shaft and by moving a slide comprising a cleaning and wringing wiper along said ensemble, said slide exerting, during its movements, a wiping action on the lower surface of the soleplate and a wringing pressure on said surface of the mop pad. The invention also relates to a washing combination allowing for the implementation of this method.

10 Claims, 10 Drawing Sheets

WASHING COMBINATION FOR THE CLEANING OF FLOORS OR OTHER PLANAR SURFACES

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention relates to a washing combination incorporating a wringing system, for the cleaning of floors or other planar surfaces. It also relates to the method of wringing of the sponge mop pad that is provided on this washing device.

2. Description of Related Art Including Information Disclosed Under 37 CFR 1.97 and CTR 1.98.

Different manual floor washing utensils are currently proposed on the market.

One of these known utensils includes a soleplate comprised of two identical pivoting plates fixed, by means of a joint, on the distal end of a shaft. On the opposite lateral edges of this soleplate, are attached the ends of a flexible mop pad which is itself fixed on a foldable framework, in conditions such that the pivoting downwards and the bringing closer together of the two portions of the soleplate cause a reverse folding of the pad which then adopts a V-shaped conformation. The soleplate and the flexible pad folded as such can be plunged into a special bucket provided with, at its upper portion, a wringing system comprised of two converging walls which, when the folded pad is inserted into said wringing system, provides a progressive bringing closer together of the two portions of the soleplate which are pressed against one another, thus providing, the wringing of said pad.

Another type of known mop comprises a plate fixed to the distal end of a shaft and against the planar lower surface of which is applied a sponge flop pad fixed, by the intermediary of its end edges, to the ends of the plate. The wringing system further comprises a special bucket of which the top is provided with a press with fingers wherein, in order to carry out the wringing, said pad is placed of which one end is detached from said plate and which remains maintained to the latter by its opposite end.

Another known device comprises a wringing system based on centrifugation, with this device comprising as particular bucket above which is placed the centrifuge wherein is placed, for the purposes of its wringing, the mop pad carried in the form of a cover maintained on the two folded portions of the small plate. Through pressure on the shaft of the utensil, a rotation is implemented and wrings said cover.

These three types of mops have the same disadvantages. They require the use of a special recipient or bucket and the quality of the wringing depends in the force that the user can provide.

U.S. Pat. No. 3,224,025, DE-10.058.690 and EP-1.208.788 describe manual washing devices for planar surfaces comprising a soleplate connected, by means of a joint, to the distal end of a shaft and carried out in two half-portions that swivel downwards and on the lower surface of which is fixed a flexible mop pad. This device comprises a press system comprising two parallel press arms oriented downwards and mounted with an ability to slide on the shaft. The lowering of this device makes it possible to exert a simultaneous pressure on the two pivoting half-plates which swivel downward resulting in the folding of the mop pad of which the surfaces delimited by the fold line are progressively pressed against one another producing the wringing of said pad.

These washing devices further have as disadvantages requiring a substantial physical effort from the user in order to obtain the pivoting downwards of the two half-portions of the pad-holder soleplate and an imperfect wringing of the pad of which the successive foldings can result in deterioration of the friction surface of said soleplate. On the other hand, when the thrust fork is raised by sliding it upwards along the shaft, the half-plates return to the coplanar position of use under the effect of return springs, which can cause splashes.

In order to overcome the disadvantages or insufficiencies of known washing utensils, a washing utensil has also been proposed (WO-02/071908 A2) comprising a shaft comprising a proximal grasping end and a distal end connected to a flat rigid swiveling soleplate, by means of a joint allowing for swiveling in two perpendicular directions, in such a way that said soleplate can occupy a variety of positions between a first end position according to which it is placed perpendicularly to the axis of the shaft and a second position wherein it is thrust against the lower portion of said shaft, in parallel to the latter, with a pad made of spongy material being fixed in a removable manner against the lower surface of the soleplate, the utensil further comprising a device for wringing comprising a roller which can be moved along the external surface of the pad fixed on the soleplate while being pressed against said pad, with this wringing roller being rigidly connected by the intermediary of a rod with a handle mounted with an ability to slide on said shaft. When the utensil is used to wash the floor, the sponge soleplate-pad unit is placed perpendicularly or in a more or less tilted manner in relation to the shaft and the device for wringing is placed in its top position, while for the wringing said device is lowered downwards, in such a way that the pressure roller rolls over said pad by compressing it.

The major disadvantage of the device described in WO-02/071908 results from the fact that although the roller effectively wrings the water from the mop pad, it also has for effect to apply the dirt against the mop pad and, consequently, to embed the latter in said mop pad. The same phenomenon is reproduced when the wringing device is raised again in its inactive top position.

EP-1 112 713 A1 and US-2002/0102573 A1 describe washing utensils similar to that which is disclosed in WO-02/071908 A2 and which have, consequently, the same disadvantages.

BRIEF SUMMARY OF THE INVENTION

The invention in particular relates to making available to users a washing combination of simple design and use, devoid of the aforementioned disadvantages of the washing devices of prior art.

It what is exposed hereinbelow, it is specified:

that the expression "washing combination" designates a mop comprising a wash head pivot-mounted at the end of a shaft b means of a joint;

that the expression "wash head" designates a rigid soleplate provided with a pad made from a spongy and compressible material;

that the expressions "top end" or "top portion" refer respectively to the end or to the portion of the soleplate which is the highest when said soleplate is placed parallel to the shaft of the washing combination considered in vertical position;

that the expressions "bottom end" or "low portion" refer respectively to the end or to the portion of the soleplate which is the lowest when said soleplate is placed parallel to the shaft of the washing combination considered in vertical position.

According to the invention, the aforementioned objective is achieved thanks to a washing combination comprising:

a shaft;

a flat and rigid non-deformable soleplate, of rectangular shape, fixed, by the intermediary of its central portion and by means of a joint, to the distal end or lower end of a shaft, with this soleplate comprising a planar lower surface;

a mop pad applied against the planar lower surface of the soleplate and fixed in a removable manner on the latter, with this mop pad being made of a spongy and compressible material;

the swiveling unit or wash head constituted by the soleplate provided with a mop pad can of occupy a variety of positions between two positions, i.e.:

a washing position wherein said wash bead is placed perpendicularly or in a tilted manner in relation to the axis of the shaft of the washing combination;

a wring position according to which said wash head is placed in a position parallel to said shaft.

a means or wringing module mounted with an ability to move along the lower portion of the shaft and along the unit constituted by the soleplate provided with the mop pad, when said unit occupies a position parallel to the shaft, said means of wringing exerting a pressure on the lower surface of the pad during his movements along said unit;

the washing combination according to the invention being in particular remarkable in that the wringing module comprises a slide mounted with an ability to slide along the shaft and the unit constituted by the soleplate and the mop pad installed on the latter, with this slide for wringing comprising a wiper oriented perpendicularly to the axis of the shaft and exerting a pressing force and wiping action on the external surface of said mop pad during its movements along the latter.

According to another advantageous arrangement the surface of the wiper intended to press against the external surface of the mop pad has a curved section.

According to another interesting arrangement the wiper is provided, over its entire length, with a longitudinal blade tilted downwards.

According to another characteristic arrangement, the soleplate of the washing combination is connected to the distal end of the shaft by means of a joint allowing for the swiveling movements of the wash head around two intersections perpendicular to the axis of said shaft.

According to another characteristic arrangement, the joint device connecting the wash head to the distal end of the shaft comprises a core provided with two cylindrical through-holes with intersecting axes, in one of these through-holes is housed a first joint axis of which the opposite ends are supported by the ends of two spaced branches that has an extension in the shape of a fork of the distal portion of said shaft, said core being housed, with a possibility of pivoting, in a space separating two supports separated from one another and constituting a boss that has, in its central portion, the upper surface of the soleplate; said supports being provided with aligned cylindrical fingers arranged opposite one another, with these fingers engaged in the ends of the second of said cylindrical through-holes.

According to another characteristic arrangement, the surfaces of the shaft and of the upper surface of the soleplate, intended to be placed opposite, are respectively provided with additional members for assembly of a temporary means for immobilizing said soleplate provided with the mop pad, against the shaft, in order to allow for the action of wringing.

These additional members for assembly can be arranged, on the one hand, for one, on one of the end portions or "top" portion of the upper surface of the soleplate and, on the other hand, for the other of said end portions, at the location arranged across from the previous one, when said soleplate is swiveled in wring position. In this way, the swiveling wringing unit can pivot in two counter directions, but it engages on a single side on the shaft.

According to another characteristic arrangement, the wiping and wringing module is connected, rigidly, to a maneuvering handle mounted with an ability to slide along the shaft by means of a tube comprising a longitudinal groove, and the joint connecting said wiping and wringing module to the distal end of said shaft is engaged, with a possibility of sliding, in said groove.

According to another characteristic arrangement, the washing combination comprises means of guiding making it possible to guide the wringing module during its movements along the unit comprised of the soleplate provided with the mop pad.

According to a preferred embodiment, the means of guiding are comprised of lateral sliders sliding along the longitudinal sides of the soleplate during the movement of said wringing module. For this purpose, the longitudinal sides of the soleplate can be provided with a guide rib.

According to another characteristic arrangement, the flop pad is fixed on the lower surface of the rigid soleplate by means of self-gripping strips, for example of the Velcro® type, of which are respectively provided the surfaces in contact of the soleplate and of the mop pad.

According to another embodiment, the end of the mop pad intended to occupy a top position during the wringing is provided with an additional fastening tab intended to be folded back against the upper surface of the soleplate, said tab and said upper surface being provided with additional means of fastening, for example of the snap-button type.

According to another characteristic arrangement, the washing combination comprises a means of immobilizing in rotation of the slide on the shaft.

According to another characteristic arrangement, the washing combination comprises means for stopping the movement of the wringing module when the latter reaches the low portion of the wash head.

The washing combination or t op according to the invention procures several advantages. In particular:

it facilitates the action of wringing of the pad of the wash head, it makes it possible to easily detach the deposits of dirt embedded in the lower surface of the sponge pad during the washing of the floors;

it is autonomous and does not require the use of a specific wringing bucket or recipient;

it does not cause the projection of splashes;

it is of simple construction and operation;

it is light and easy to use.

The invention further relates to a method of wringing the sponge mop pad provided on the mops comprising a soleplate whereon is applied such a pad, and fixed to the distal end of a shaft, characterized in that the cleaning and the wringing of the mop pad, are obtained simultaneously by placing the unit comprised of said soleplate and said mop pad in a position parallel to the axis of the shaft and by moving a slide for cleaning and wringing along said unit, said slide comprising a wiper exerting, during its movements, a wiping of the external surface of the pad making it possible to detach the deposits and dirt embedded in said surface during the washing of the floors, and a pressure on said surface allowing for the wringing of said pad.

BRIEF DESCRIPTION OF THE SEVERAL VIEWS OF THE DRAWINGS

The purposes, characteristics and advantages hereinabove, and others in addition, shall be understood better in the following description and annexed drawings, wherein.

Figure 1:
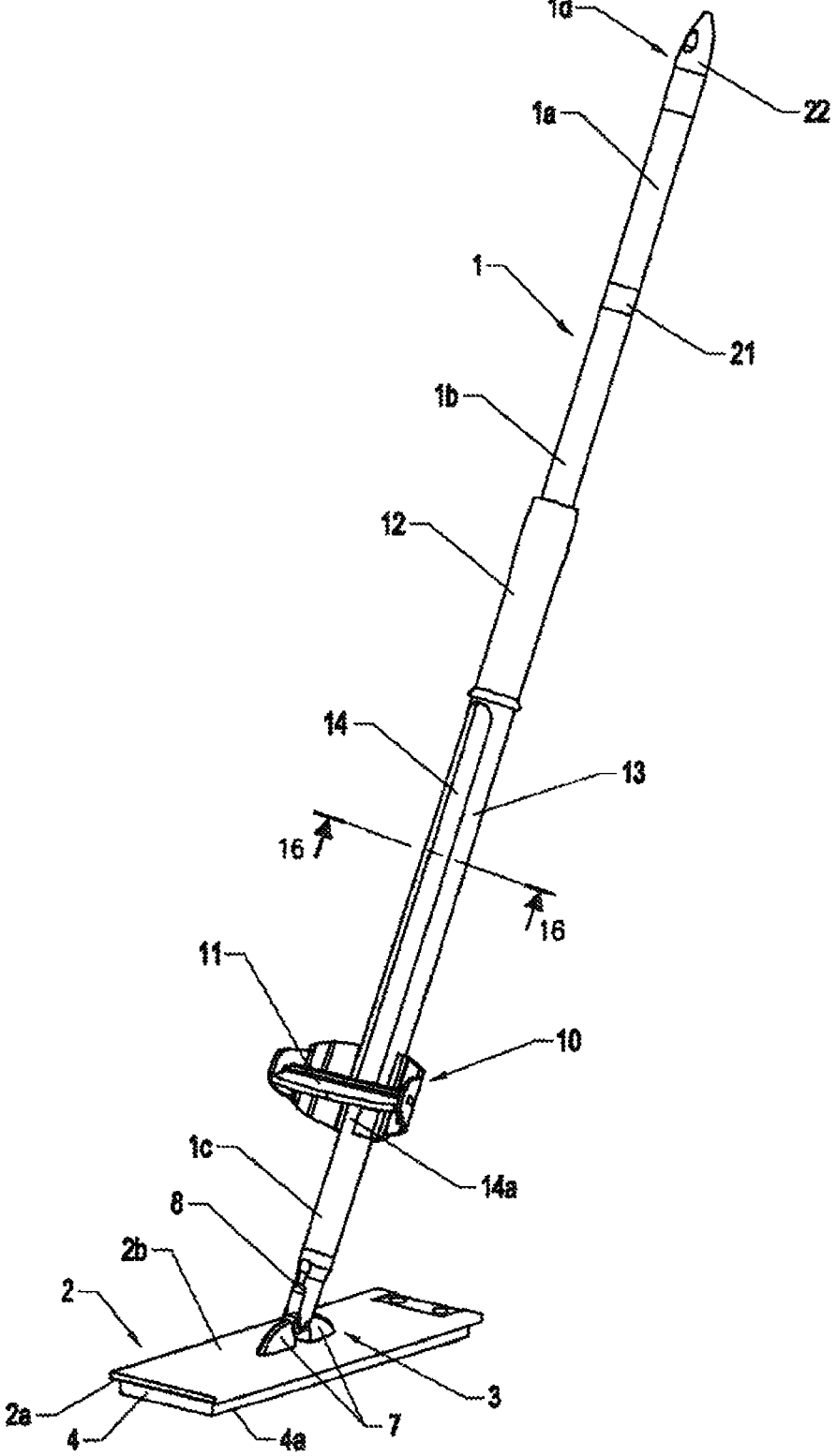
FIG. 1 is a perspective view of an example embodiment of the mop or washing module according to the invention, shown in the position of use.
Figure 2:
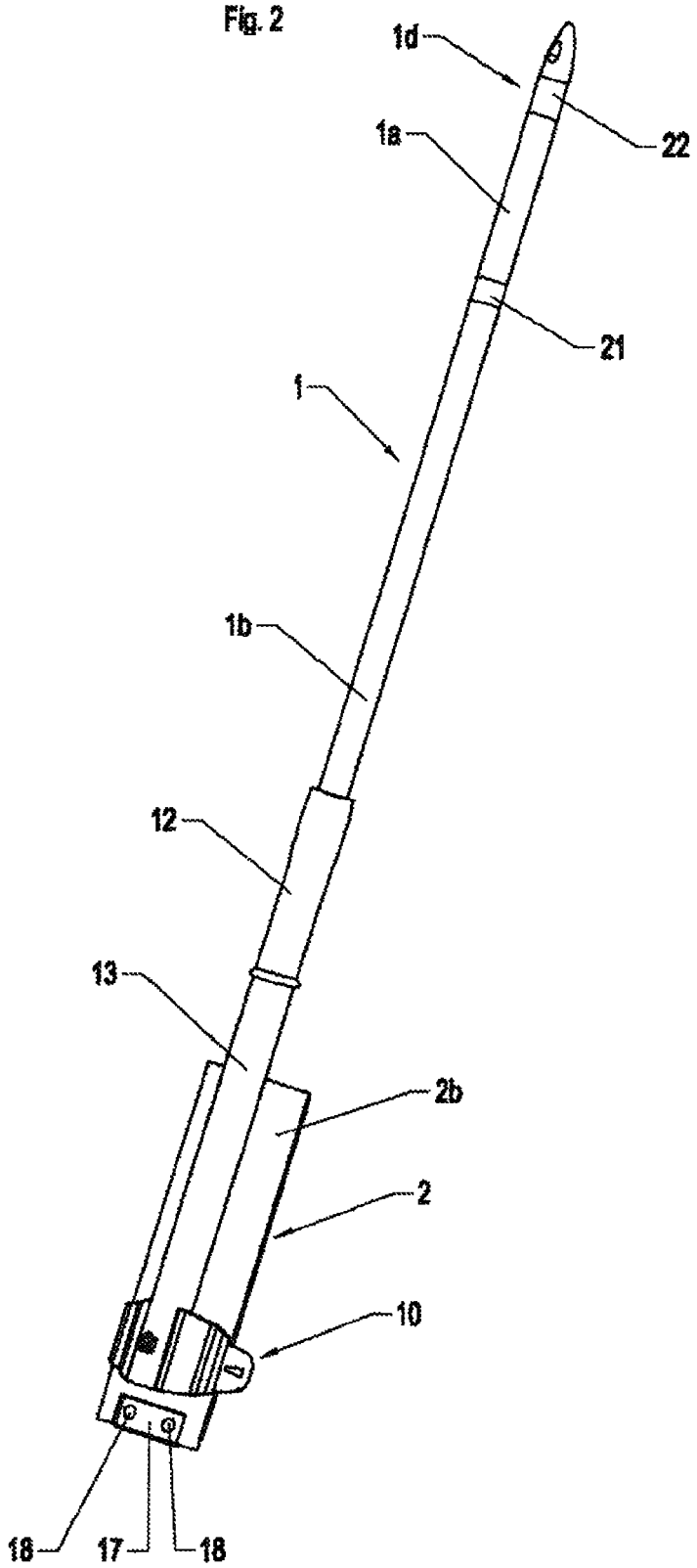
FIG. 2 is a perspective view showing this mop in the wring position.
Figure 3:
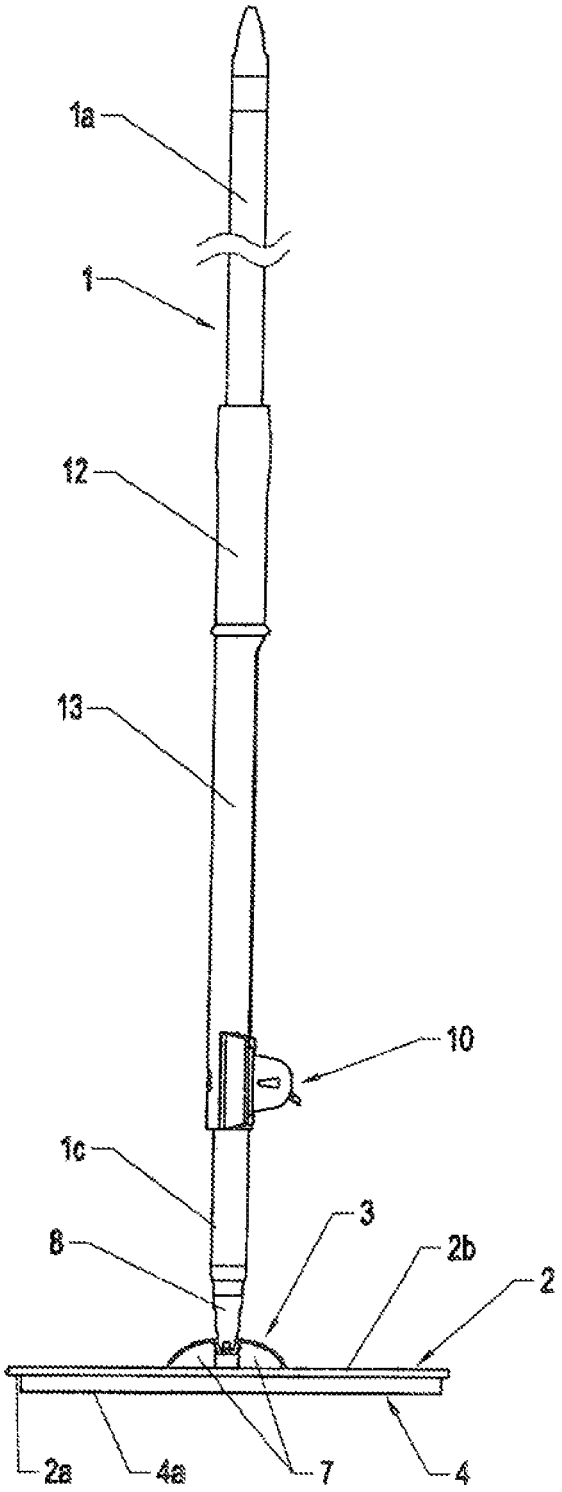
FIG. 3 is a front view showing the mop in position of use.
Figure 4:
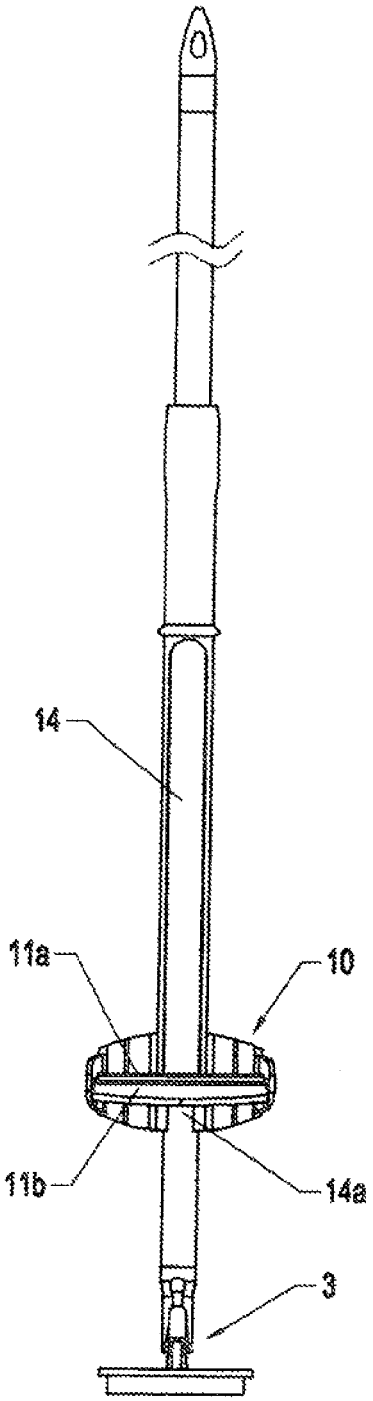
FIG. 4 is a side view of the FIG. 3.

Reference is made to said drawings in order to describe an advantageous example, although in no way restricted, of carrying out the washing combination or mop, and of implementing the method, according to the invention.

DETAILED DESCRIPTION OF THE INVENTION

This washing combination comprises, in a manner known per se:

a shaft 1 which can be formed from a single piece or from at least two portion 1*a*, 1*b* assembled telescopically in such a way as to allow for an adjustment of the length of the shaft, or to decrease its length in order to reduce its encumbrance; with this shaft comprising a proximal grasping portion 1*a* and a distal portion 1*c;* a non-deformable rigid soleplate 2, or pad-holder plateau, of rectangular shape, fixed by a joint 3 to the distal end 1*c* or lower end of the shaft, with this rigid soleplate comprising a generally planar lower surface 2*a*; it can have for example a dimension of approximately 300 mm×100 mm;

an interchangeable mop pad 4 applied and fixed, in a removable manner, against the planar lower surface 2*a* of the rigid soleplate 2 and covering more preferably, the totality of said lower surface; said mop pad 4 and said soleplate 2, constituting a swiveling wash head 2-4.

In the case where the shaft is formed of two or more than two pieces, assembled telescopically, a ring 21, for example made of plastic material, and arranged at the junction of two portions forming the telescopic shaft, makes it possible to block the pieces in position after adjustment of the length of the shaft.

The shaft 1 and the soleplate 2 can be made from any materials having the solidity and the lightness desired, for example aluminum or aluminum alloy, or from any suitable rigid plastic materials. The portions forming the washing combination can also be made from identical materials (except for the sponge pad) or different materials.

The upper end 1*d* of the shaft 1 can further be provided with a tip 22, for example made from plastic material. This tip 22 has an orifice making it possible to hook the washing combination onto a support hook during its storage.

The interchangeable mop pad 4 can be made from any flexible, compressible and spongy material that has the property of absorbing and retaining liquids, and of rejecting them under pressure, such as textile materials, for example terry fabrics, cotton fabric, fabrics comprised, of microfibers, etc., or cellular plastic materials, etc. By way solely of example, this mop pad can have, when dry, a thickness of approximately 12 mm.

Figure 5:
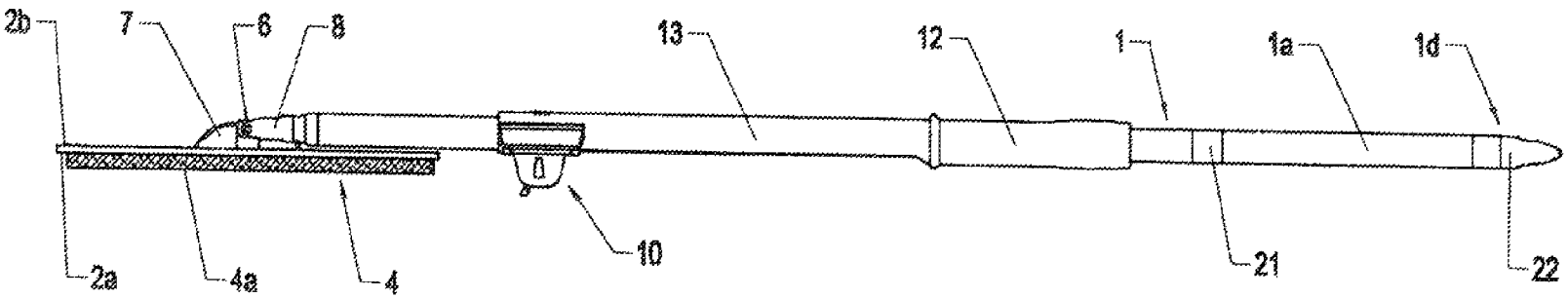
FIG. 5 is a side view showing the mop before the lowering of the slide for wiping and wringing.
Figure 6:
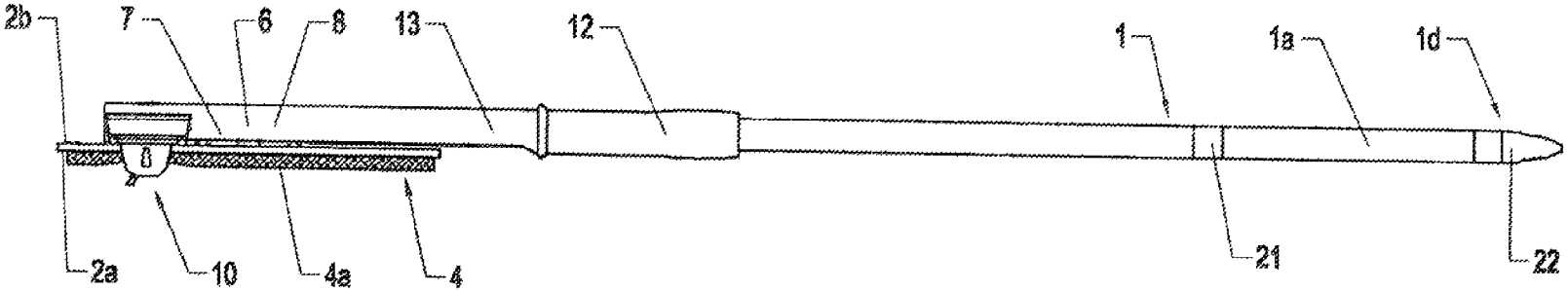
FIG. 6 is a side view similar to FIG. 5 showing the slide for wiping and wringing, in the process of wringing.
Figure 7:
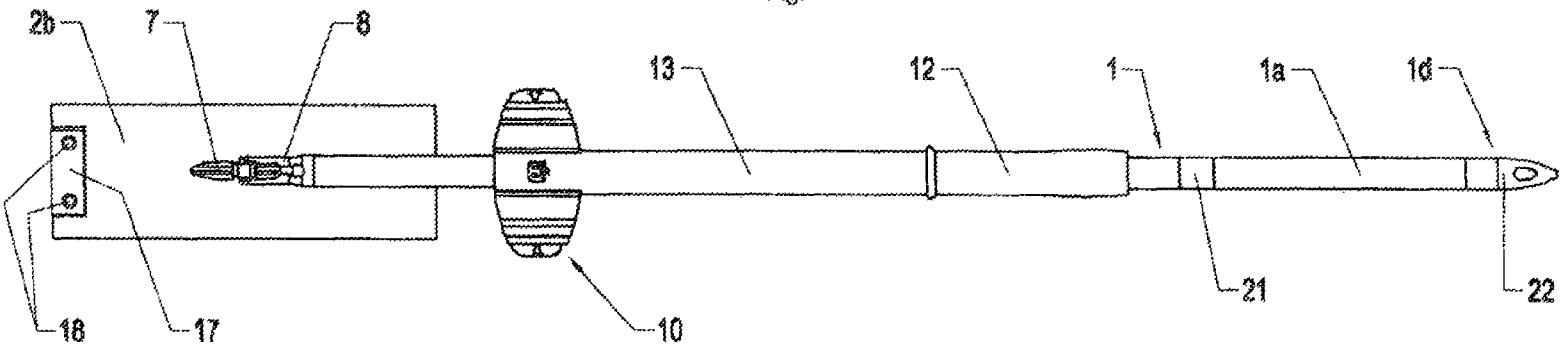
FIG. 7 is a front view of the FIG. 5.
Figure 8:
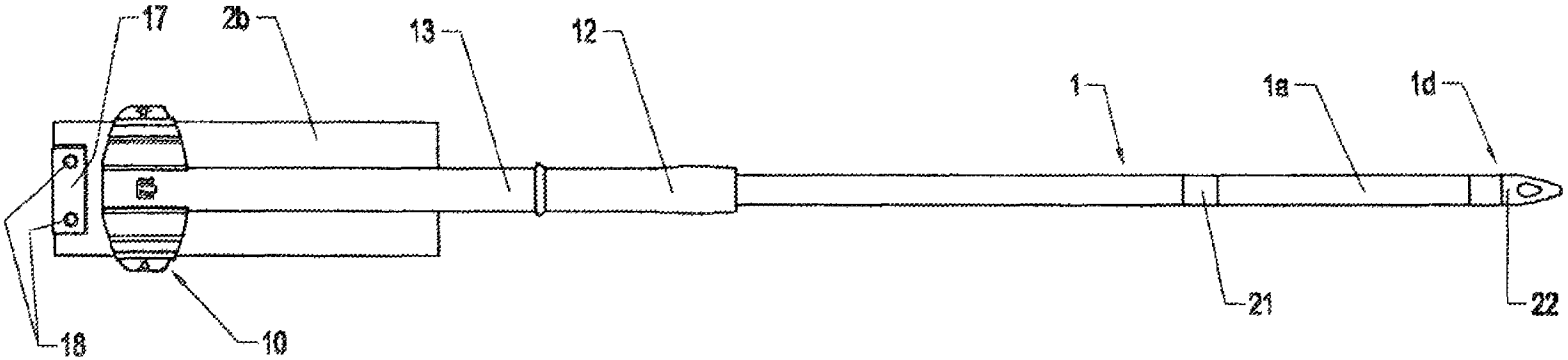
FIG. 8 is a front view showing the slide for wiping and wringing at the end of the travel of wringing.
Figure 9:
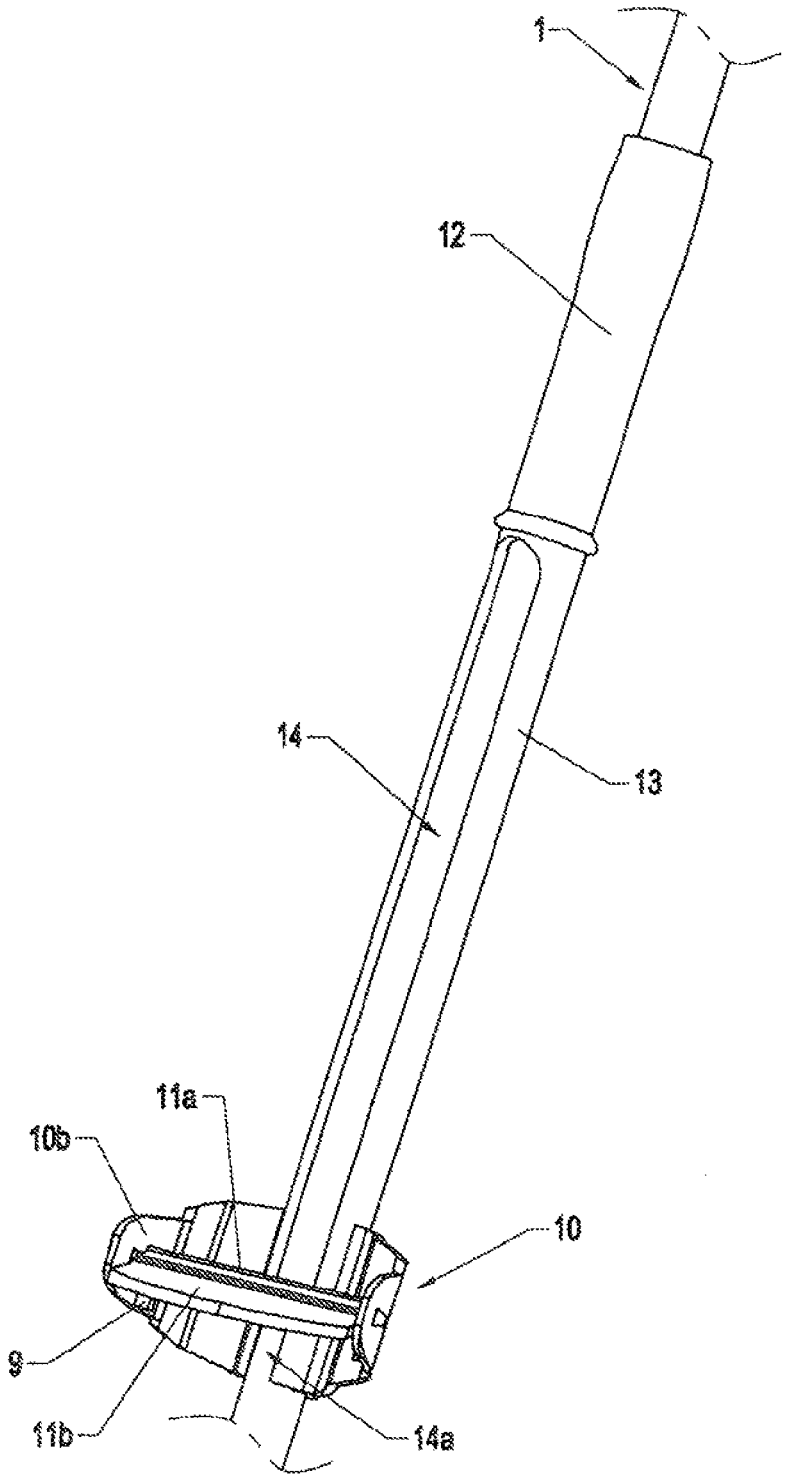
FIG. 9 is a perspective view of the slide or wiping and wringing module.
Figure 10:
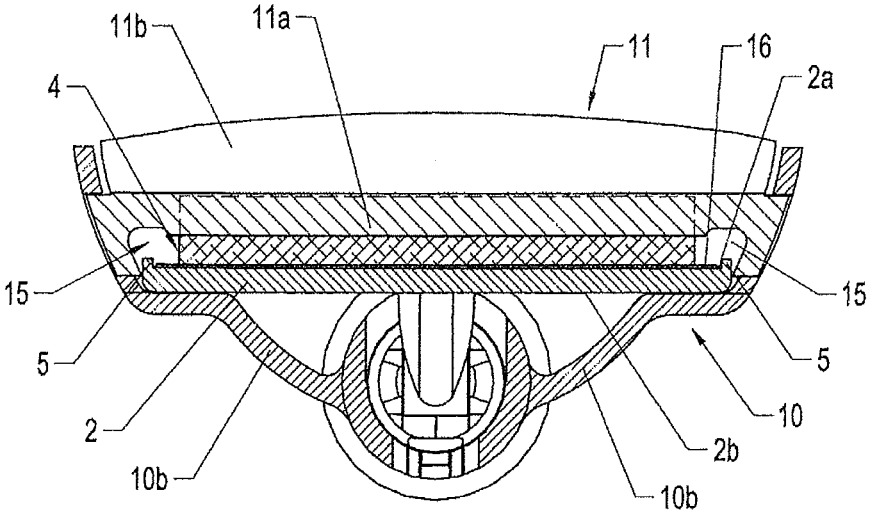
FIG. 10 is a transverse cross-section view of the slide for wiping and wringing in wring position.

The swiveling wash head 2-4 constituted by the soleplate 2 provided with a mop pad 4 can occupy a variety of positions between two end positions, i.e.:

a first washing position according to which said wash head is oriented perpendicularly or in a tilted manner in relation to the axis of the shaft 1 of the mop FIG. 1);

a second position of wiping and of wringing according to which said wash head is placed in a position parallel to said shaft (FIGS. 5 and 6).

The washing combination further comprises a wring module mounted with an ability to move along the lower portion of the shaft 1 and along the wash head 2-4, when said wash head occupies a position parallel to said shaft; in this situation, the wring module exerts a pressure on the external face or lower surface 4*a* of the pad 4 during its movements along said wash head.

The soleplate 2 of the washing combination is connected to the distal end of the shaft 1 by means of a joint 3 comprising an axis 6 oriented perpendicularly to the axis of the shaft 1. This joint axis 6 is arranged at a distance from the plane P-P wherein is comprised the upper surf 2*b* of the soleplate 2, in such a way that the latter can be placed in a wring position parallel to the axis of the shaft.

Figure 14:
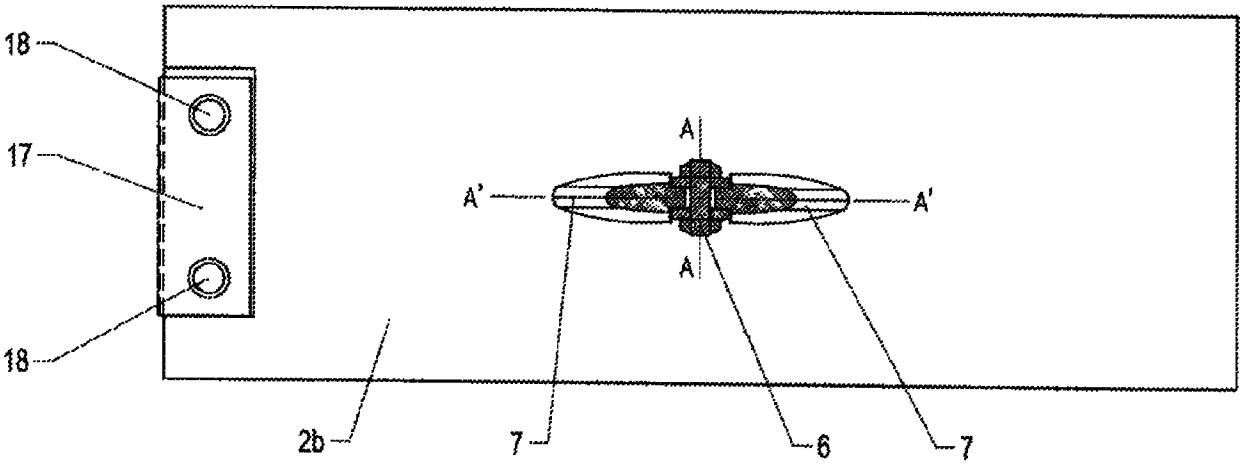
FIG. 14 is a transverse cross-section view according to the line 14-14 of the FIG. 12.
Figure 15:
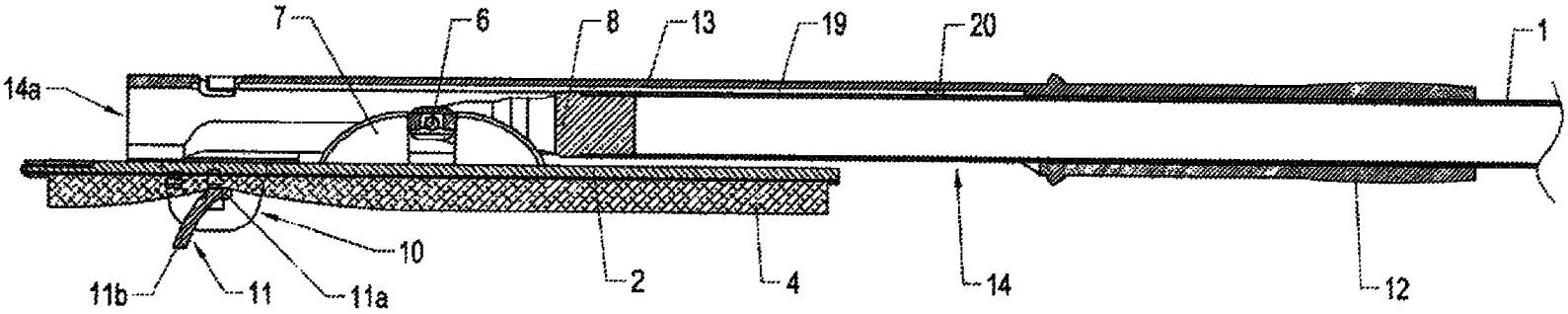
FIG. 15 is a cross-section view of the lower portion of the washing combination.

Advantageously, the soleplate 2 is connected to the distal end of the shaft 1, by the intermediary of a joint allowing for free movements of the wash head 2-4 in two perpendicular directions to the axis of said shaft (axes A-A and A'-A', FIG. 14).

Preferably, the soleplate 2 is connected to the end of the shaft 1 by means of at joint 3 constituted by a universal joint for example by a joint of the Cardan joint type.

According to a substantial arrangement characteristic of the invention, a wiping and wringing module is mounted with an ability to slide along the shaft and along the unit constituted by the soleplate 2 and the mop pad 4 installed on the latter, this wiping and wringing module comprises a slide 10 comprising a wiper constituted by a rigid pressure strip 11 oriented perpendicularly to the axis of the shaft 1 and exerting a pressing force and a wiping action on the external surface or lower surface of said mop pad, during its movements along said unit 2-4.

Preferably, the joint device 3 connecting the wash head 2-4 to the distal end of the shaft 1 comprises a boss that has, in its central portion, the upper surface of the soleplate and a core 23 provided with two cylindrical through-holes with intersecting axes. In one of these through-holes is housed a first joint axis 6 of which the opposite ends are supported by the ends of two spaced branches 8 that has an extension in the shape of a fork of the distal end 1*c* of the shaft 1.

On the other hand, the core 23 is housed with a possibility of swiveling, in a space 24 separating two supports 7*a* separate from one another and constituting a boss 7 that has, in its central portion, the upper surface 2*b* of the soleplate 2. These supports 7*a* are provided with cylindrical fingers 25 and arranged opposite one another, with these fingers being engaged in the ends of the second of said cylindrical holes, in such a way that said core can rotate around said fingers 25.

It is understood that the wash head 2-4 can as such swivel around two perpendicular axes A-A and A'-A'.

The slide for wiping and wringing 10 is rigidly connected to a maneuvering handle 12 arranged separate from said slide for wringing and mounted with an ability to slide along the shaft. The maneuvering handle is connected to the slide for wiping and wringing by the intermediary of a tube 13 arranged around the shaft 1 and comprising a longitudinal groove 14.

This longitudinal groove 14 extends to the distal end of the connection tube 13 where is located its entrance 14*a* wherein is engaged the joint 3, at the beginning of the course of downward travel of the unit 10-13-12.

The longitudinal groove 14 has a width allowing for the passage of the joint 3, during movements of the unit 10-13-12. It makes it possible to overcome the obstacle constituted by the joint 3, with the opposite edges of said groove 14 sliding on either side of said joint, during movements of the split connection tube 13.

Figure 11A:
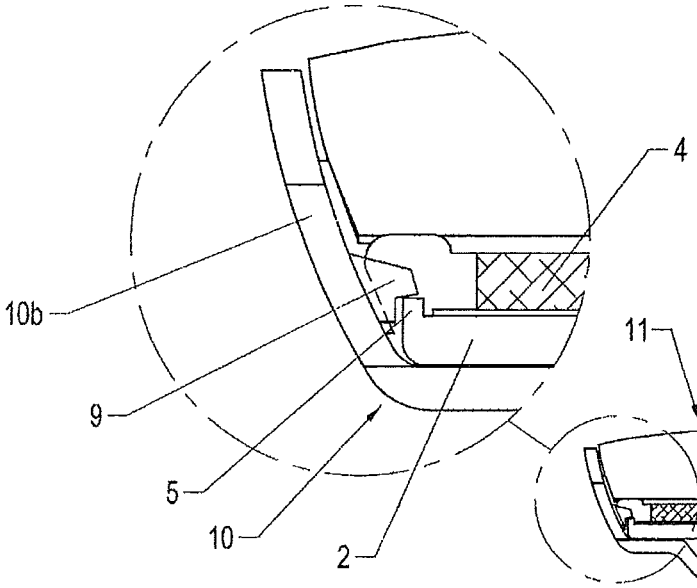
FIGS. 11*a* and 11B are detailed views showing the means of immobilizing of the soleplate in a position parallel to the axis of the shaft.
Figure 11B:
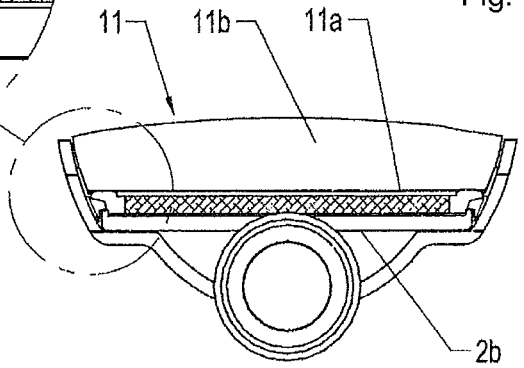
Figure 12:
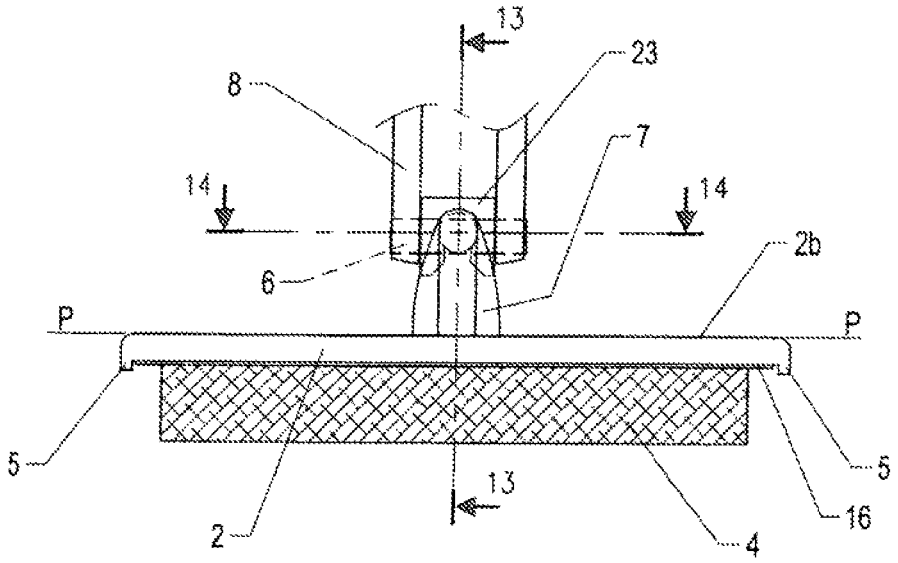
FIG. 12 is a detailed and side view and of the joint of the soleplate at the distal end of the shaft.
Figure 13:
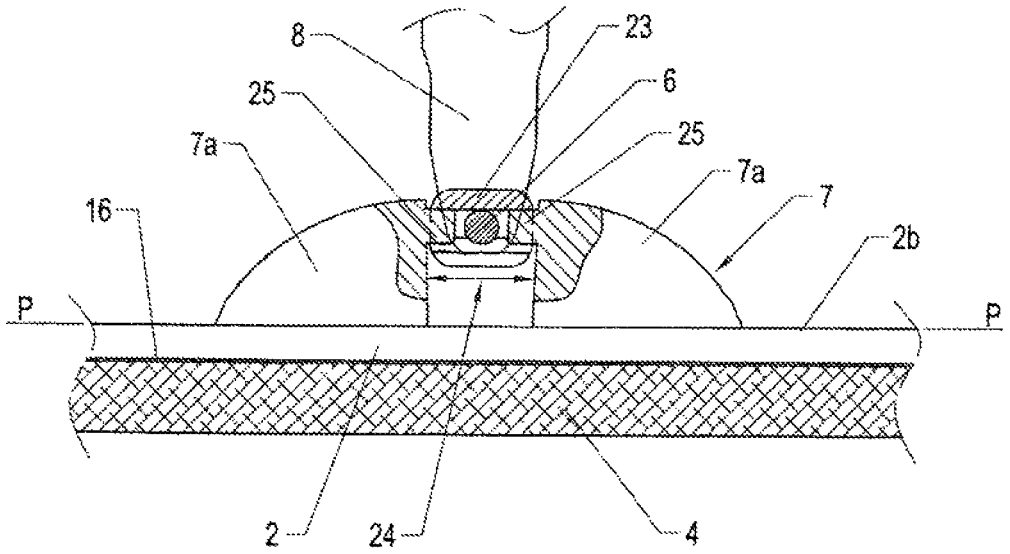
FIG. 13 is a planar and cross-section view according to the line 13-13 of the FIG. 12.

Means 9 (FIGS. 11*a* and 11*b*) make possible the centering and the guiding of the soleplate parallel to the shaft in the wring position. These means include, for example, retaining lugs 9 that have the sides of the body 10*b* of the slide 10, and underneath which the ribs 5 of the edges of the soleplate are engaged instantly when the latter is swiveled into its position parallel to the shaft.

These means of centering and guiding 9 make it possible to maintain the soleplate 2 provided with a mop pad 4 in a position parallel to the shaft 1 during the entire duration of the wringing phase.

The rigid pressure strip or wiper it has a length at least equal to the width of the mop pad 4 and more preferably a length slightly greater than said width.

It has, across its entire length, a support surface 11*a* with curved section in order to favor its sliding over the external surface of the mop pad 4, while still allowing for an effective wiping action of said external surface of the mop pad. This curved support surface is preferably comprised of the edge of the wiper intended to exert a pressure on the pad 4 during the movements in translation of said wiper along said pad. On the other hand, the wiper 11 further comprises, across its entire length, a longitudinal blade 11*b* opposed to upwellings of dirty water above said wiper during movements of the latter in the downward direction as well as in the upwelling direction.

This blade 11*b* is tilted in the direction of the low portion of the washing combination, for example according to an angle of approximately 30°.

Means of guiding make it possible to guide the wiping and wringing module 10 during its movements along the wash head 2-4. These means of guiding can be constituted by slides or lateral sliders 15 of which is provided the lower portion of the wringing wiper 11, with these sliders sliding along the longitudinal sides of the soleplate 2 during the movement of said slide.

Figure 16:
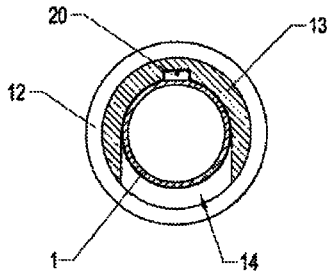
FIG. 16 is a detailed, transverse cross-section view, showing the means of guiding and abutment limiting the downward travel of the wiping and wringing module.
Figure 17:
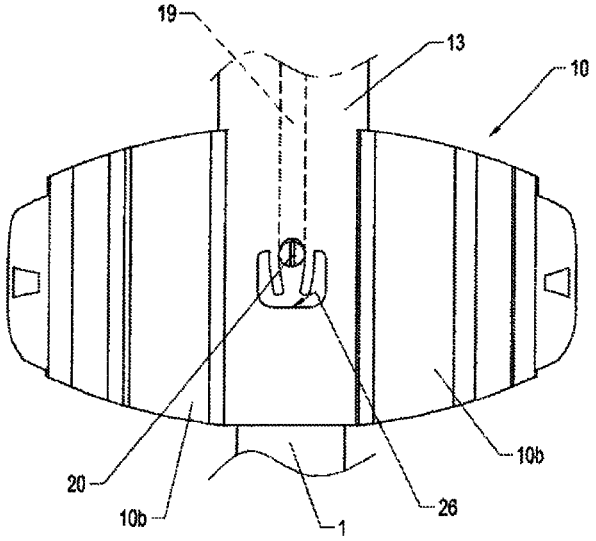
FIG. 17 is a detailed and front view and with partial pulling off of these means of abutment.

A means of abutment limit the course of travel of the movement upwards and especially downwards of the slide for wiping and wringing 10, in order to oppose the uncoupling of the soleplate 2 and of said slide for wringing 10 when the wiper 11 reaches the bottom end of the mop pad 4. This means of abutment comprises (FIGS. 16 and 17): on the one hand, a longitudinal groove 19 arranged in the internal surface of the tube 13, opposite the groove 14 and, on the other hand, an abutment 20 rigidly fixed on the lower portion of the shaft. During movements of the unit 10-13-12, the abutment 20 slides in the groove 19 and when this abutment arrive in contact with the top end of said groove designated by the reference 26 in FIG. 17), the movement downwards of said unit 10-13-12 is stopped.

The mop pad 4 can have a length and a width equal or substantially equal to those of the lower surface 2*a* of the rigid soleplate 2. Advantageously, it is fixed on the lower surface of the rigid soleplate 2 by means of self-gripping strips 16, for example of the Velcro® type, of which are respectively provided the surfaces in contact with the soleplate and with the mop pad.

The end of the mop pad intended to occupy a top position in the wring position, is provided with an additional flexible fastening tab 17. After application of the mop pad 4 against the lower surface of the soleplate, this tab 17 is folded back against the upper surface of the soleplate and is fixed to the latter by all suitable means of attaching. For example, the tab 17 and the upper surface 2*b* of the soleplate 2 are respectively provided with removable means of fastening, for example of the snap-button type 18*a*, 18*b*.

Replacing a used mop pad with a new mop pad can take place rapidly and easily in the following way:

the used mop pad is firstly detached from the lower surface 2*a* of the soleplate pulling on its end opposite to that which is provided with the tab 17 then entirely "peeled off" from said lower surface before detaching it from said soleplate by unsnapping the snap-buttons 18*a*, 18*b;* the new mop pad is then installed by proceeding in the reverse manner: hooking of the tab 17 onto the surface of the upper surface of the soleplate reserved for this purpose b means of snap-buttons 18*a*, 18*b*, after which is applied the face of the pad provided with self-gripping strips on the lower surface of the soleplate provided with additional self-gripping strips, by exerting an action of traction in order to stretch it in order to obtain its proper positioning. This arrangement makes it possible to closely thrust the mop pad 4 against the lower surface 2*a* of the soleplate by preventing the formation of blisters.

The mop further comprises a means of immobilizing in rotation of the slide for wringing on the shaft 1 so that said slide has the correct position in order to be able to engage with the longitudinal edges of the rigid soleplate 2 provided with a pad for wringing 4. This means of immobilizing comprises the groove 19 and the abutment 20 of the previously described anti-rotation system.

Alternatively, the shaft 1 and the split tube 13 mounted with an ability to slide on the latter, could have non-circular sections, for example an ovoid section opposing any rotation of one of the elements in relation to the other.

In order to carry out the wringing of the pad 4 fixed on the soleplate 2 of a washing combination according to the invention, while still detaching any deposits of dirt that have adhered to the lower surface of the mop pad 4 during the cleaning of the floor, the following procedure is carried out:

the wash head 2-4 of the combination is plunged in an ordinary bucket idled with water or other rinsing or washing liquid, more preferably of rectangular shape and it is tipped in such a way as to place it parallel to the axis of the shaft 1. In order to obtain this tipping, one of the ends of the wash head is pressed against one of the walls of the bucket, which causes it to tip;

at the end of the course of travel of the tipping, the upper wall of the soleplate comes into contact with said shaft and automatically is engaged on the latter;

then the wringing module 10 can then be lowered and raised by the intermediary of the handle 12 in such a way as to obtain its sliding, downwards or upwards by being guided by the parallel lateral edges of the soleplate; during this sliding, the wiper 11 exerts a wiping action and a pressure on the sponge pad and consequently, an action of wringing of the latter;

then the wringing module is then raised up which, during its upward movement, carried out an additional action of wringing of the mop pad the operation can be repeated one or several times if necessary;

in order to unlock the wash head, in order to put the washing combination back into position for use, all that is required, after having raised the wringing module, is to strike the bottom end of the latter against the floor, in order to cancel the action of the means of immobilizing 9 and to obtain the swiveling of the wash head into position for use.

I claim:

1. A washing assembly comprising:

a shaft;

a rigid soleplate having a joint affixed at a central portion there, said shaft having a distal end connected to said joint, said soleplate having a planar lower surface;

a mop pad removably applied against said planar lower surface of said soleplate, said mop pad formed of a spongy and compressible material, said soleplate and said mop pad movable between a washing position in which said soleplate and said mop pad are perpendicular or tilted relative to said longitudinal axis of said shaft and a wringing position in which said soleplate and said mop pad are arranged in parallel relation to the longitudinal axis of said shaft; and a wring module movably mounted along a lower portion of said shaft and along said soleplate and said mop pad when in the wringing position so as to exert a pressure onto an external surface of said mop pad, said wring module comprising:

a slide slidably mounted to said shaft; and a wiper affixed to said slide and oriented perpendicular to the longitudinal axis of said shaft, said wiper exerting a pressing force and a wiping action onto said external surface of said mop pad when said soleplate and said mop pad are in the wringing position, said wiper having a longitudinal blade extending across an entire length thereof, said longitudinal blade being tilted downwardly.

2. The washing assembly of claim 1, said wiper having a curved surface.

3. A washing assembly comprising:

a shaft;

a rigid soleplate having a joint affixed at a central portion thereof, said shaft having a distal end connected to said joint, said soleplate having a planar lower surface;

a mop pad removably applied against said planar lower surface of said soleplate, said mop pad formed of a spongy and compressible material, said soleplate and said mop pad movable between a washing position in which said soleplate and said mop pad are perpendicular or tilted relative to said longitudinal axis of said shaft and a wringing position in which said soleplate and said mop pad are arranged in parallel relation to the longitudinal axis of said shaft; and a wring module movably mounted along a lower portion of said shaft and along said soleplate and said mop pad when in the wringing position so as to exert a pressure onto an external surface of said mop pad, said wring module comprising:

a slide slidably mounted to said shaft; and a wiper affixed to said slide and oriented perpendicular to the longitudinal axis of said shaft, said wiper exerting a pressing force and a wiping action onto said external surface of said mop pad when said soleplate and said mop pad are in the wringing position; and a maneuvering handle rigidly connected by a tube to said wring module, said maneuvering handle slidable along said shaft, said tube having a longitudinal groove, said joint extending outwardly a distance from a plane of the upper surface of said soleplate, said longitudinal groove having a portion slidably receiving said joint.

4. The washing assembly of claim 3, said wring module having lateral sliders arranged thereon so as to slide along respective longitudinal sides of said soleplate during the movement of said wring module.

5. The washing assembly of claim 3, said joint being a Cardan joint.

6. The washing assembly of claim 3, said joint having a core with a pair of cylindrical through holes having intersecting axes, one of said pair of cylindrical through holes housing a first joint axis having opposite ends supported by end of a pair of spaced branches that have a fork-shaped extension at a distal end of said shaft, said core being housed in a space between a pair of supports, said core having a boss that is affixed to the upper surface of said soleplate, said pair of supports having aligned cylindrical fingers arranged opposite to each other, the cylindrical fingers being engaged in ends of another of said pair of through-holes.

7. The washing assembly of claim 3, said mop pad being affixed by self-gripping strips to said lower surface of said soleplate.

8. The washing assembly of claim 7, said mop pad having a fastening tab that is foldable back against said upper surface of said soleplate, said fastening tab being fastenable to said upper surface of said soleplate.

9. The washing assembly of claim 3, further comprising:

a means for selectively immobilizing in rotation said ring module on said shaft.

10. The washing assembly of claim 3, further comprising:

an abutment cooperative between said ring module and said shaft so as to limit a course of travel of said ring module on said shaft.

* * * * *